US005416995A

United States Patent [19]

Teng

[11] Patent Number: 5,416,995

[45] Date of Patent: May 23, 1995

[54] DISPLAY DEVICE HAVING UNIVERSALLY SWINGING DECORATIVE ARTICLE

[76] Inventor: Hsieh-Yi Teng, c/o Hung Hsing Patent Service Center P. O. Box 55-1670, Taipei (10477), Taiwan, Prov. of China

[21] Appl. No.: 157,526

[22] Filed: Nov. 26, 1993

[51] Int. Cl.[6] ..... G09F 19/08

[52] U.S. Cl. ..... 40/419; 40/409; 446/354

[58] Field of Search ..... 40/409, 410, 414, 417, 40/418, 419, 420; 446/352, 353, 354

[56] References Cited

U.S. PATENT DOCUMENTS

| | | | |
|---|---|---|---|
| 4,040,206 | 8/1977 | Kimura | 446/352 |
| 4,852,283 | 8/1989 | Teng | 40/410 X |
| 5,092,065 | 3/1992 | Teng | 40/410 |
| 5,176,560 | 1/1993 | Wetherell et al. | 446/354 X |

*Primary Examiner*—Brian K. Green

[57] ABSTRACT

A display device includes a decorative model for simulating a doll, people, animal and the other articles with the decorative model having a base provided with a driving device within the base, a rotary body such as a crystal ball rotatably mounted in a central or middle portion of the decorative model and driven by the driving device such as a spring or a motor and a swing device such as a pair of swinging arms of a doll or a people universally secured to the decorative model by a universal joint, having at least a coupling link slidably coupled to an endless groove recessed in a universal rail circumferentially sinuously wound on a spherical surface of the rotary body, whereby upon operation of the driving device to rotate the rotary body, the swinging arms of the swinging device will be swung along the universal rail disposed on the rotary body to produce a three-dimensional decorative effect for the decorative model.

5 Claims, 4 Drawing Sheets

DISPLAY DEVICE HAVING UNIVERSALLY SWINGING DECORATIVE ARTICLE

BACKGROUND OF THE INVENTION

A display device having doubly rotatable decorative articles of U.S. Pat. No. 5,092,065 was issued to the same inventor of this application, which includes a crystal ball held on a base having an upper decorative article rotatably mounted in a top plug formed on an upper portion of the crystal ball, and a lower decorative article mounted on a packing disk rotatably mounted in the base, so that both upper and lower decorative articles are rotatable either in a same direction or different directions, for enhancing decorative interest and increasing diversified features.

However, either the upper or lower decorative articles is rotated within the crystal ball, not extendible to an outside of the crystal ball, thereby still lacking of decorative effect on a three-dimensional point of view.

SUMMARY OF THE INVENTION

The object of the present invention is to provide a display device including: a decorative model for simulating a doll, people, animal and the other articles having a base provided with a driving device within the base, a rotary body such as a crystal ball rotatably mounted in a central or middle portion of the decorative model and driven by the driving device such as a spring or a motor, and a swinging device such as a pair of swinging arms of a doll or a people universally secured to the decorative model by a universal joint, having at least a coupling link slidably coupled to an endless groove recessed in a universal rail circumferentially sinuously wound on a spherical surface of the rotary body, whereby upon operation of the driving device to rotate the rotary body, the swinging arms of the swinging device will be swung along the universal rail disposed on the rotary body to produce a three-dimensional decorative effect for the decorative model.

DETAILED DESCRIPTION

Figure 1:
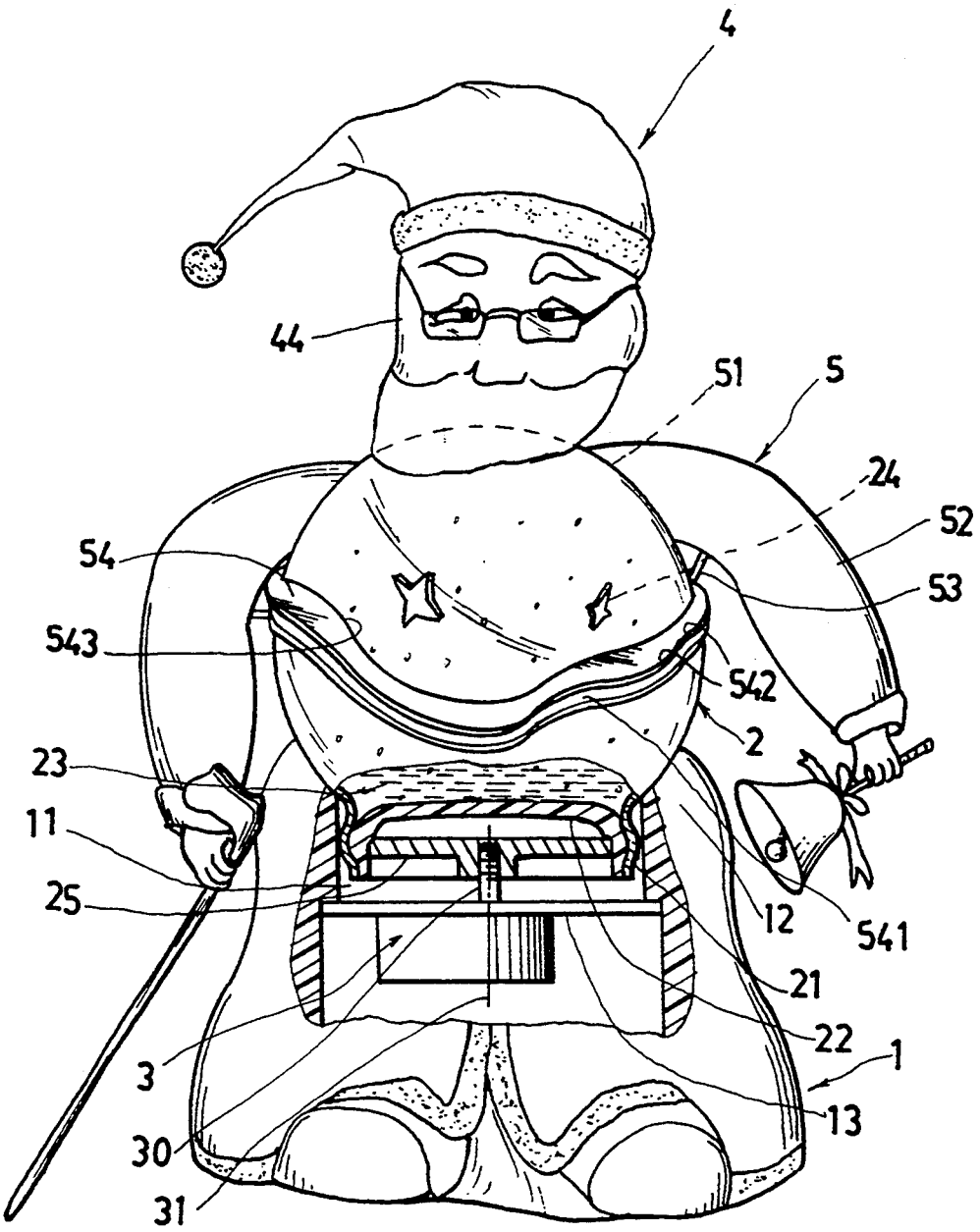
FIG. 1 is a partial cut-away front view of the present invention.
Figure 2:
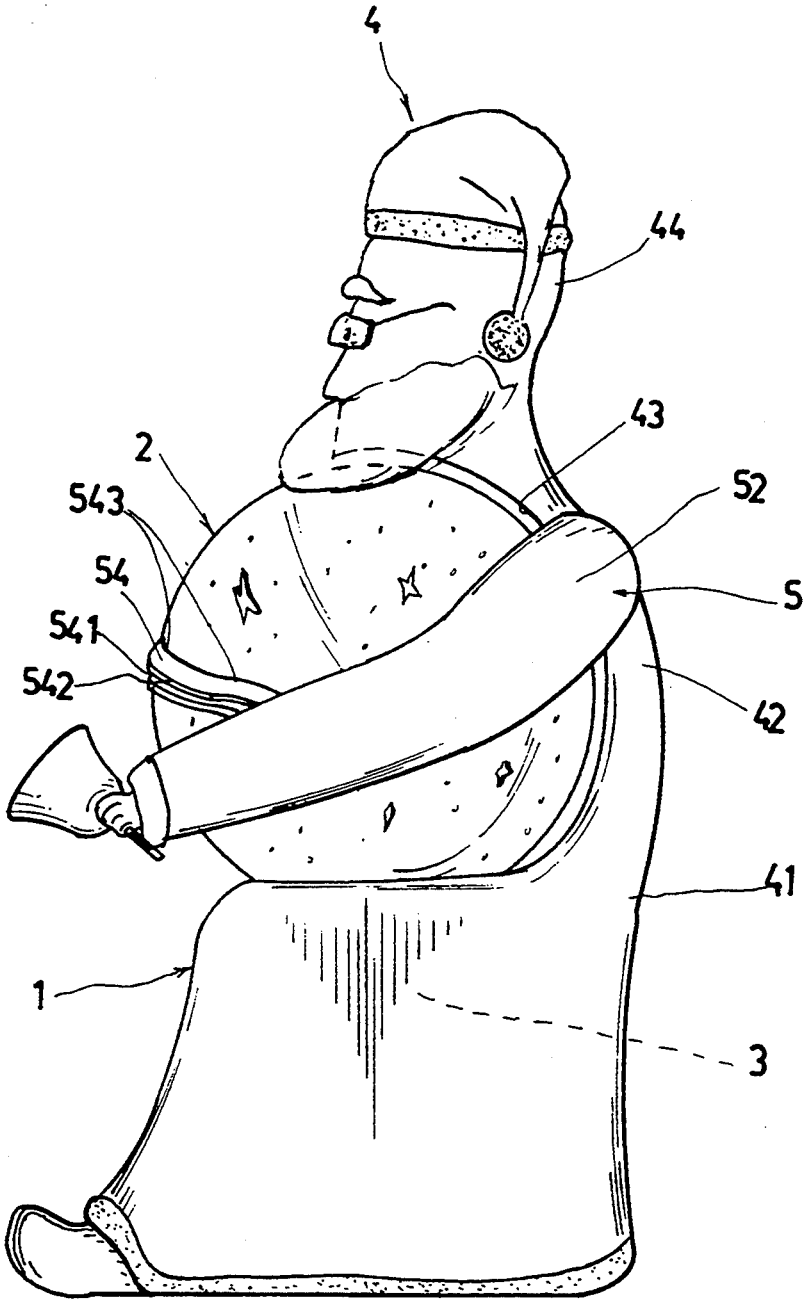
FIG. 2 is a side view of the present invention.
Figure 3:
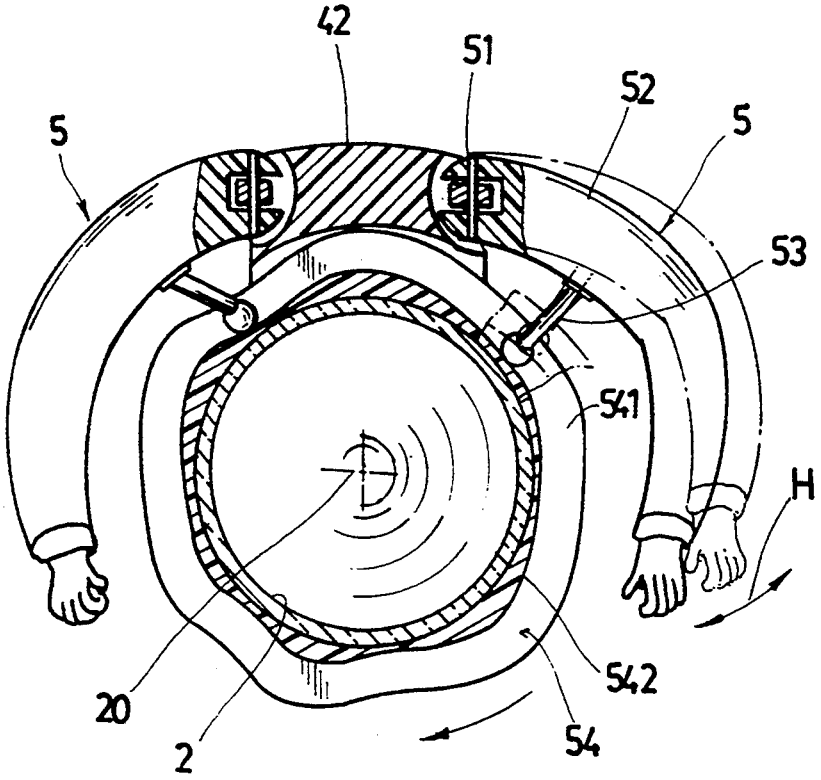
FIG. 3 is a partial cross sectional drawing of the present invention.
Figure 4:
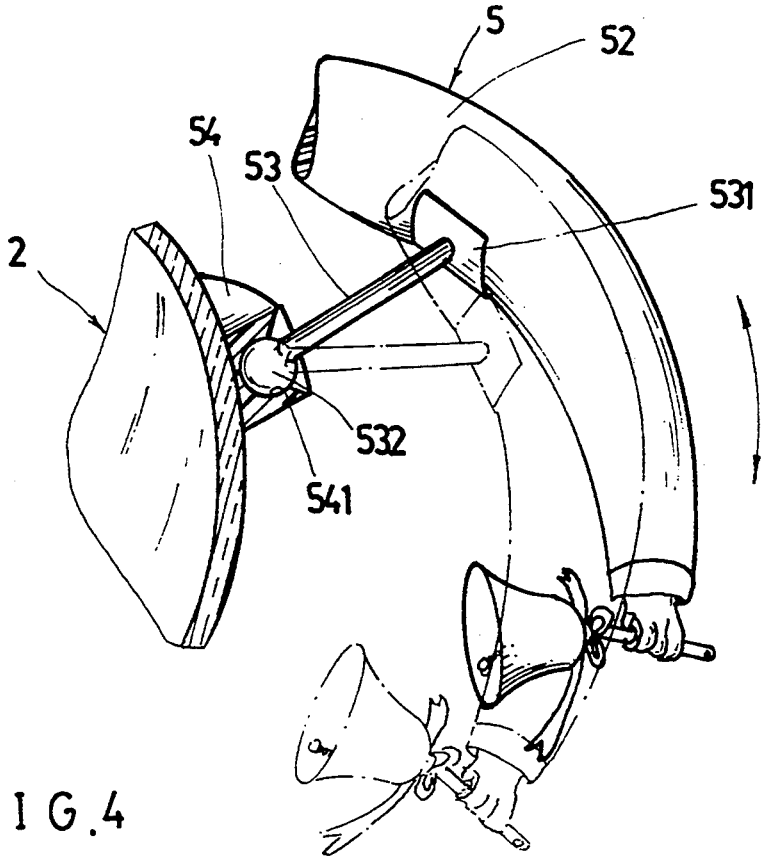
FIG. 4 is an illustration showing a universal coupling operation in accordance with the present invention.

As shown in the drawing figures, the present invention comprises: a base 1, a rotary means 2, a driving means 3, a decorative model 4, and a swinging means 5.

The base 1 includes: a central hole 11 formed in a central portion of the base 1, an annular extension 12 annularly formed on an upper perimeter of the base 1 for shielding a lower portion of the rotary means 2, and a retaining plate 13 secured in the central hole 11 of the base 1 for mounting the driving means 3 within the base 1.

The rotary means 2 generally formed as a transparent crystal ball includes: a bottle-neck portion 21 formed on a lower portion of the rotary means 2 rotatably disposed within the annular extension 12 of the base 1, a packing disk 22 inserted in the bottle-neck portion 21 for sealing a liquid (or water) 23 filled in the crystal ball of the rotary means 2, a plurality of interior decorative articles 24 such as miniature objects for imitating stars, snow flakes, etc. suspending in the liquid 23 within the crystal ball, a retaining disk 25 embedded in the packing disk 22 to be connected on a transmission shaft 30 of the driving means 3 so as to rotate the crystal ball about an axis 31 aligned with the transmission shaft 30 when driven by the driving means 3.

The driving means 3 may be selected from a spring system provided in a musical box, or driving motor, not limited in this invention.

The decorative model 4 provided for simulating a doll, a people, an animal or a plant, includes: a lower body portion 41 integrally connected with the base 1, a back portion 42 protruding upwardly from the lower body portion 41 and the base 1, an intermediate body portion 43 recessed rearwardly to form a cavity (such as for simulating a chest portion) for rotatably holding the rotary means 2 in the cavity of the intermediate body portion 43, and a head portion 44 secured on a top portion of the intermediate body portion 43 and the back portion 42.

The decorative model 4 may be formed for simulating a doll, Santa Claus, or other creatures. For simulating Santa Claus as shown in the accompanying figures, the two arms of the Santa Claus may be referred to a pair of swinging arm members 52 of the swinging means 5 of this invention, the rotary means 2 serving as a chest and abdomen and the base 1 may be modified to provide a lower body portion including a pair of legs as clearly illustrated in FIG. 1.

The simulations of the decorative model 4 of this invention are not limited, which can be modified to imitate a bird with two swinging arm members 52 serving as two wings of a bird.

During the rotation of the crystal ball of the rotary means 2, the interior decorative articles 24 will be rotated and the outside swinging arm members 52 will be simultaneously swung along an universal rail for enriching decorative function on a three-dimensional point of view.

The swinging means 5 includes: a universal joint 51 secured on a back portion 42 of the decorative model 4, at least a swinging arm member 52 universally connected to the decorative model 4, a coupling link 53 having an outer link end 531 secured with the swinging arm member 52, and a universal rail 54 circumferentially sinuously wound on a spherical surface of the rotary means 2 and slidably engageable with an inner coupling head 532 of the coupling link 53 for universally biasing the swinging arm member 52 about a fulcrum positioned at the universal joint 51.

Figure 5:
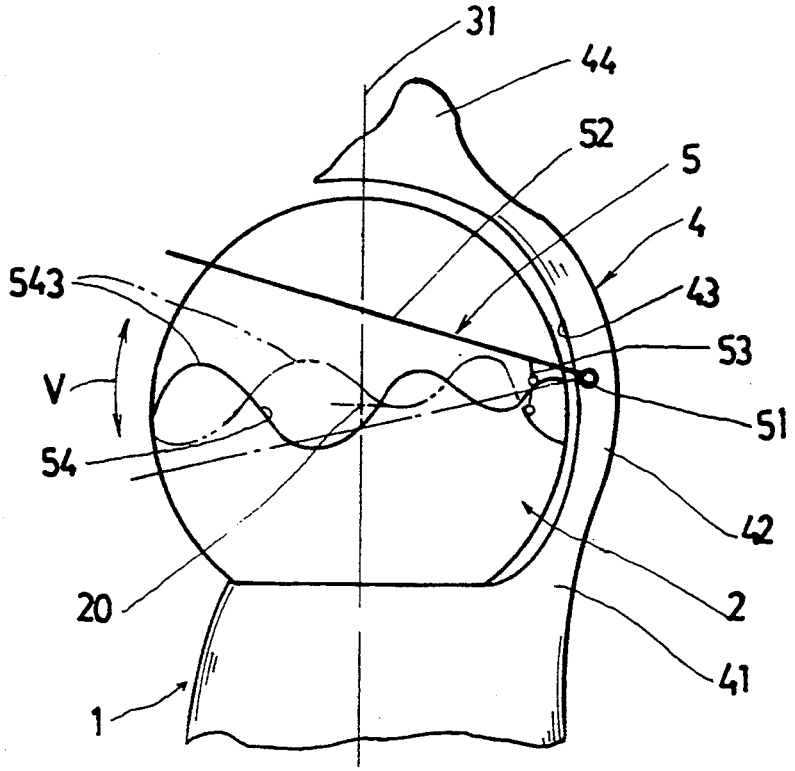
FIG. 5 is an illustration showing a vertical swinging movement of the present invention.
Figure 6:
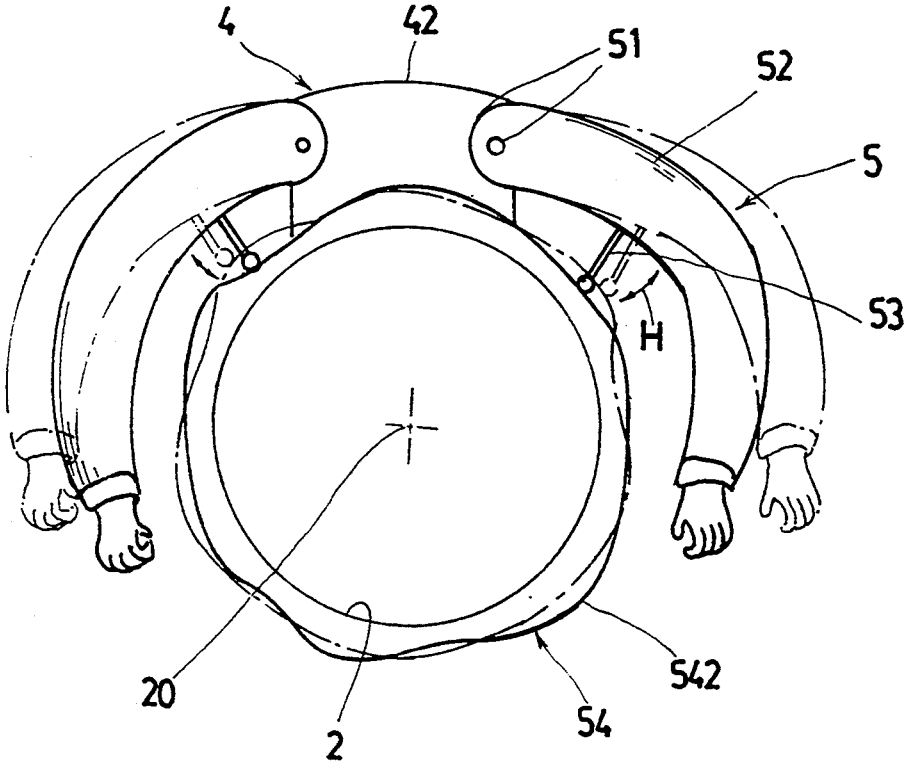
FIG. 6 is an illustration showing a horizontal swinging movement of the present invention.

The universal rail 54 includes: an endless groove 541 continuously recessed with equal depth in the rail 54 for slidably engaging the inner coupling head 532 of the coupling link 53, with the rail 54 consisting of a transversal sinuous track 542 transversely sinuously disposed on a circumferential surface of the rotary means 2 about a sphere center 20 of the rotary means 2 as shown in FIG. 6 having different radii of the transversal sinuous track 532 about the sphere center 20 and having different thickness of the transversal sinuous track 532 protruding outwardly from a spherical surface of the rotary means 2 to thereby bias the swinging arm member 52 about the fulcrum at the universal joint 51 for horizontally swinging the arm member 2 as shown in reciprocal direction H as shown in FIG. 6; and a longitudinal sinuous track 543 longitudinally sinuously disposed on the spherical surface of the rotary means 2 about an axis 31 of the driving means 3 and about the sphere center 20 of the rotary means 2 with the sphere center 20 coinciding with the axis 31 having different heights based upon a level across the sphere center 20 to thereby bias the swinging arm member 552 about the universal joint 51 for vertically swinging the arm member 52 as shown in reciprocal direction V as shown in FIG. 5, and the endless groove 541 engageable with the inner coupling head 532 of the coupling link 53 operatively guiding the coupling link 53 for sinuously moving along the longitudinal sinuous track 543 and the transversal sinuous track 542 for universally biasing the swinging arm member 52 about the universal joint 51.

Since each swinging arm member 52 is universally pivoted about the joint 51 as also universally linked to the universal rail 54, a rotation of the rotary means 2 will drive the coupled arm member 52 to bias universally in diversified orientations to have vivid decorative effect to increase user's interest.

The vertical (V) and horizontal (H) movement as shown in FIGS. 5, 6 are the static analysis of the swinging arm member 52. Actually, the movement of the arm member 52 is universally operated by synthesizing both movements as shown in FIGS. 6 and 5.

Therefore, this invention provides a universally swinging decorative article having diversified three-dimensional swinging orientations to enhance its "dynamic" decorative effect.

I claim:

1. A display device comprising:

a decorative model for simulating a doll, a person, an animal and an article, said decorative model having a lower portion of the model integrally secured with a base;

a rotary means rotatably mounted in said base and rotatably held in a middle portion of said decorative model as driven by a driving means mounted in said base; and a swinging means having at least a swinging member universally pivotally secured to said decorative model and having means coupled to a universal rail circumferentially sinuously disposed on a spherical surface of said rotary means, whereby upon rotation of said rotary means to rotate said universal rail on said rotary means, said swinging member will be universally biased and swung on said model as guided by said rail on said rotary means to diversify a plurality of swinging orientations thereof.

2. A display device according to claim 1, wherein said base includes:

a central hole formed in a central portion of the base, an annular extension annularly formed on an upper perimeter of the base for shielding a lower portion of the rotary means, and a retaining plate secured in the central hole of the base for mounting the driving means within the base; and said rotary means generally formed as a transparent crystal ball including:

a bottle-neck portion formed on a lower portion of the rotary means rotatably disposed within the annular extension of the base, a packing disk inserted in the bottle-neck portion for sealing a liquid filled in the crystal ball of the rotary means, a plurality of interior decorative articles suspending in the liquid within the crystal ball, a retaining disk embedded in the packing disk to be connected on a transmission shaft of the driving means so as to rotate the crystal ball about an axis aligned with the transmission shaft when driven by the driving means.

3. A display device according to claim 1, wherein said decorative model includes:

a lower body portion integrally connected with the base, a back portion protruding upwardly from the lower body portion and the base, an intermediate body portion recessed rearwardly to form a cavity in front of the back portion for rotatably holding the rotary means in the cavity of the intermediate body portion, and a head portion secured on a top portion of the intermediate body portion and the back portion.

4. A display device according to claim 1, wherein said swinging means includes:

a universal joint secured on a back portion of the decorative model, at least a swinging arm member universally connected to the decorative model, a coupling link having an outer link end secured with the swinging arm member, and an universal rail circumferentially sinuously wound on a spherical surface of the rotary means and slidably engageable with an inner coupling head of the coupling link for universally biasing the swinging arm member about a fulcrum positioned at the universal joint.

5. A display device according to claim 4, wherein said universal rail includes:

an endless groove continuously recessed with equal depth in the rail for slidably engaging an inner coupling head of the coupling link, with the rail consisting of a transversal sinuous track transversely sinuously disposed on a circumferential surface of the rotary means about a sphere center of the rotary means having different radii of the transversal sinuous track about the sphere center and having different thickness of the transversal sinuous track protruding outwardly from a spherical surface of the rotary means to thereby bias the swinging arm member about the fulcrum at the universal joint for horizontally swinging the arm member; and a longitudinal sinuous track longitudinally sinuously disposed on the spherical surface of the rotary means about an axis of the driving means and about the sphere center of the rotary means with the sphere center coinciding with the axis having different heights based upon a level across the sphere center to thereby bias the swinging area member about the universal joint for vertically swinging the arm member, and the endless groove engageable with the inner coupling head of the coupling link operatively guiding the coupling link for sinuously moving along the longitudinal sinuous track and the transversal sinuous track for universally biasing the swinging arm member about the universal joint.

* * * * *